US006521113B2

(12) United States Patent
Strangman et al.

(10) Patent No.: US 6,521,113 B2
(45) Date of Patent: Feb. 18, 2003

(54) METHOD OF IMPROVING THE OXIDATION RESISTANCE OF A PLATINUM MODIFIED ALUMINIDE DIFFUSION COATING

(75) Inventors: Thomas E. Strangman, Phoenix, AZ (US); Derek Raybould, Denville, NJ (US); Alex Kozlov, Wharton, NJ (US)

(73) Assignee: Honeywell International Inc., Morristown, NJ (US)

( * ) Notice: Subject to any disclaimer, the term of this patent is extended or adjusted under 35 U.S.C. 154(b) by 67 days.

(21) Appl. No.: 09/895,761

(22) Filed: Jun. 29, 2001

(65) Prior Publication Data

US 2001/0045363 A1 Nov. 29, 2001

Related U.S. Application Data

(62) Division of application No. 09/482,335, filed on Jan. 14, 2000, now Pat. No. 6,306,277.

(51) Int. Cl.[7] ..... C23C 28/00

(52) U.S. Cl. ..... 205/191; 205/261; 205/264; 205/192; 205/224; 205/227; 427/255.28; 427/248.1

(58) Field of Search ..... 205/261, 264, 205/104, 255, 257, 191, 192, 224, 227; 427/521, 248.1, 255.28

(56) References Cited

U.S. PATENT DOCUMENTS

| | | | |
|---|---|---|---|
| 1,779,436 A | 10/1930 | Keitel | |
| 1,779,457 A | 10/1930 | Zschiegner | |
| 1,901,531 A | 3/1933 | Powell et al. | |
| 1,906,178 A | 4/1933 | Powell et al. | |
| 1,970,950 A | 8/1934 | Wise | |
| 1,991,995 A | 2/1935 | Wise | |
| 2,027,358 A | 1/1936 | Powell et al. | |
| 2,792,341 A | 5/1957 | Atkinson | |
| 2,847,372 A | 8/1958 | Dijksterhuis et al. | |
| 2,984,603 A | 5/1961 | Duva et al. | |
| 3,206,382 A | 9/1965 | Wilson et al. | |
| 3,347,757 A | 10/1967 | Lacroix et al. | |
| 3,351,541 A | 11/1967 | Lyons, Jr. et al. | |
| 3,467,584 A | 9/1969 | Lyons, Jr. | |
| 3,480,523 A | 11/1969 | Tyrrell | |
| 3,592,750 A | 7/1971 | Runcorn | |
| 3,671,408 A | 6/1972 | Martini | |
| 3,841,980 A | 10/1974 | Grosbois et al. | |
| 3,865,697 A | 2/1975 | Suggs | |
| 4,310,392 A | 1/1982 | Kohl | |
| 4,358,352 A | 11/1982 | Rhoda | |
| 4,427,502 A | 1/1984 | Abys | |
| 4,750,977 A | 6/1988 | Marrese | |
| 5,421,991 A | 6/1995 | Yarita | |
| 5,549,738 A | 8/1996 | Kitada et al. | |
| 5,788,823 A | 8/1998 | Warnes et al. | |
| 6,306,277 B1 * | 10/2001 | Strangman et al. | 205/261 |

FOREIGN PATENT DOCUMENTS

| | | |
|---|---|---|
| EP | 0358375 | 3/1990 |

OTHER PUBLICATIONS

PCT Search Report dated Jul. 04, 2001; PCT/US 01/01280; Applicant: Honeywell International Inc.

F.H. Reid: "Electrodeposition of the platinum group metals"; 1963; XP002169503; 1257. No month avail.

Database WPI; Section CH, Week 197508; Derwent Pulications LTD., London, GB; AN 1975–13899W; XP002170277 & SU 422 797 A (Gen Inorg Chem UKR AS), Aug. 30, 1974.

Hopkin et al., *Bright Platinum Plating,* pp. 56–58, (1960), No month avail.

Keitel et al., *Electrodeposition of Platinum, Palladium and Rhodium,* pp. 273–275, (Apr. 25, 1931).

* cited by examiner

*Primary Examiner*—Nam Nguyen
*Assistant Examiner*—Wesley A. Nicolas
(74) *Attorney, Agent, or Firm*—Robert Desmond, Esq.

(57) ABSTRACT

An electrolyte for use in electrolytic platinum plating that results in reduced Cl, S, or P contaminant production. The bath comprises 0.01 to 320 g/lit of platinum in the form of the platinum salt dinitrodiammine platinum, $Pt(NH_3)_2(NO_2)_2$ or variants thereof and 0.1 to 240 g/lit of alkali metal carbonate $M_2CO_3$ or bicarbonate $MHCO_3$ where M is selected from a group comprising lithium (Li), sodium (Na), potassium (K), rubidium (Rb) and cesium (Cs). A method of improving oxidation resistance of a platinum modified aluminide diffusion coating on a substrate, comprises electroplating the substrate using this electrolyte and then aluminizing the electroplated substrate at an elevated temperature to grow a platinum modified aluminide diffusion coating.

12 Claims, No Drawings

METHOD OF IMPROVING THE OXIDATION RESISTANCE OF A PLATINUM MODIFIED ALUMINIDE DIFFUSION COATING

CROSS-REFERENCE TO RELATED APPLICATIONS

This is a divisional application of U.S. patent application Ser. No. 09/482,335 filed Jan. 14, 2000, now U.S. Pat. No. 6,306,277.

TECHNICAL FIELD

The present invention relates to platinum modified aluminide diffusion coatings and methods for making such coatings using a platinum plating technique that improves the purity of the coating and its resistance to high temperature oxidation.

BACKGROUND OF THE INVENTION

In modern gas turbine engines, the blades and vanes in the high pressure turbine section are exposed to temperatures in excess of 1000 degrees C for extended periods of time. Oxidation distress of turbine components is commonly inhibited by the application of platinum aluminide coatings. Protection provided by Pt-aluminide coatings is due to selective oxidation of aluminum to form an alumina ($Al_2O_3$) scale that grows very slowly at high temperature by a diffusion process. Impurities within the coating, notably sulfur, can segregate to the interface between the coating and the alumina scale, weaken the interface, and thus promote spalling of the protective oxide scale. Periodic oxide spalling accelerates the consumption of aluminum from the Pt-aluminide coating and reduces the oxidation life of the component. Impurity induced oxide spalling of the protective oxide also limits the life of thermal barrier coatings that utilize Pt-aluminide coatings as a bond coating.

It has been observed that commercial electroplating processes that are used to apply a thin (1 to 5 micron) layer of platinum to the component (prior to diffusion and aluminizing) contribute significantly to the amount of undesirable impurities present in a Pt-aluminide coating. Consequently, there is a need for a plating process that greatly reduces the concentration of impurities (specifically, S, Cl, and P) present within the plating to levels that are comparable or preferably below the levels present within the superalloy substrate.

In the production of platinum modified aluminide diffusion coated gas turbine engine components, such as blades and vanes, the components are conveniently electroplated to deposit platinum metal on their gas path surfaces prior to aluminizing. Some prior art plating baths employ hexachloroplatinic acid ($H_2PtCl_6$) as a source of platinum. Examples include the phosphate buffer solution as described in U.S. Pat. Nos. 3,677,789 and 3,819,338 or an acid chloride bath similar to that outlined by Atkinson in Trans. Inst. Metal Finish. vol. 36 (1958 and 1959) page 7. Sulfate solutions also have been used in the past which utilize a P salt [$(NH_3)_2Pt(NO_2)_2$] precursor as described by Cramer et al. in Plating vol. 56 (1969) page 516 or $H_2Pt(NO_2)_2SO_4$ precursor as described by Hopkins et al. in Plat. Met. Rev. vol. 4 (1960) page 56. Finally, some platinum aluminide coating procedures utilize a platinum Q salt [$(NH_3)_4Pt(HPO_4)$] bath as discussed by Albon, Davis, Skinner and Warren in U.S. Pat. No. 5,102,509. Conventionally well known platinum plating baths contain high concentrations of sulfur and/or phosphorous and/or chlorine, and the deposition reactions in all these baths involve complex ions with ligands containing sulfur and/or phosphorous and/or chlorine.

A disadvantage in using these electrolytes is that it results in the co-deposition of P, S and Cl impurities into the Pt coating. The presence of these impurities essentially reduces the life of the Pt-aluminide coating, the thermal barrier coating that uses a Pt-aluminide coating as the bond-coat, and consequently the life of the article.

One proposed solution to this problem is disclosed in Warnes et al. U.S. Pat. No. 5,788,823. Warnes teaches a method of improving the oxidation resistance of platinum modified aluminide diffusion coatings by electroplating platinum onto a substrate using an aqueous caustic solution based on an platinum hydroxide and alkali hydroxide or alkaline earth hydroxide. Use of the hydroxide plating solution significantly reduces the presence of such harmful impurities as phosphorus and/or sulfur and/or chlorine in the platinum deposit and thus in the platinum modified aluminide diffusion coating formed on the substrate.

One disadvantage to using the electrolyte disclosed in Warnes is that after being made up, it rapidly becomes turbid and a deposit of hydrated Pt oxide forms on the anode. With more prolonged use a heavy flocculent precipitate of various Pt compounds is formed, whereby the effective Pt content of the bath is reduced and Pt coatings become dull, patchy and loosely adherent. To avoid this problem, the addition of Sodium Chloride (NaCl) and Sulfuric Acid is suggested which leads to increased cost and a contamination of the electrolyte and Pt coatings with Cl and S impurities.

Another disadvantage to this electrolyte is that it absorbs carbon dioxide from the atmosphere. As a result, periodic addition of NaOH (KOH) is necessary which leads to build-up of alkali carbonates $M_2CO_3$ in the electrolyte, incorporation of the alkali metal into the Pt coating and consequently a reduction of the electrolyte lifetime.

Accordingly, there exists a need for an electrolyte that can be used on electrolytic plating of platinum that results in reduced Cl, S, or P contaminant production and platinum coatings that are not dull, patchy and loosely adherent.

SUMMARY OF THE INVENTION

An object of the present invention is to provide an electrolyte that when used in electrolytic platinum plating results in reduced Cl, S, or P contaminant production.

Another object of the present invention is to provide an improved electrolytic platinum plating process wherein the platinum coatings are not dull, patchy or loosely adherent.

The present invention achieves this object by providing an electrolyte comprising an aqueous solution of 0.01 to 320 g/lit of platinum in the form of the platinum salt dinitrodiammine platinum, [$Pt(NH_3)_2(NO_2)_2$] or variants thereof and 0.1 to 240 g/lit of alkali metal carbonate $M_2CO_3$ or bicarbonate $MHCO_3$ where M is selected from a group comprising lithium (Li), sodium (Na), potassium (K), rubidium (Rb) and cesium (Cs).

Also disclosed is a method of improving oxidation resistance of a platinum modified aluminide diffusion coating on a substrate, comprising electroplating the substrate with a layer comprising platinum from an aqueous electroplating solution based on a carbonate and aluminizing the electroplated substrate at an elevated temperature to grow a platinum modified aluminide diffusion coating having improved oxidation resistance.

These and other objects, features and advantages of the present invention are specifically set forth in or will become apparent from the following detailed description of a preferred embodiment of the invention.

DESCRIPTION OF THE PREFERRED EMBODIMENT

An electrolytic platinum plating electrolyte according to the present invention is an aqueous solution comprising 0.01 to 320 g/lit of platinum in the form of the platinum salt dinitrodiammine platinum, $[Pt(NH_3)_2(NO_2)_2]$ or variants thereof and 0.1 to 240 g/lit of alkali metal carbonate $M_2CO_3$ or bicarbonate $MHCO_3$ where M is selected from a group comprising lithium (Li), sodium (Na), potassium (K), rubidium (Rb) and cesium (Cs).

In a manner familiar to those skilled in the art, the plating bath can be used in conventional electrolytic platinum plating processes. In such processes, either a DC power supply or a pulse power supply can be used to produce voltage preferably in the range of 0.2 to 6 volts and current density preferably in the range 0.05 to 7 $A/dm^2$. The solution temperature is preferably in the range of 15 to 98° C.

In a more preferred embodiment, the electrolyte comprises 10 g/lit of platinum salt and 100 g/lit of sodium carbonate $Na_2CO_3$ and the operational conditions are 1.1 volts, 0.5 $A/dm^2$ and a solution temperature of 60° C.

This electrolyte provides highly stable electrolytic plating of ultra pure Pt on superalloys. It does not form insoluble Pt compounds at plating or during storage because of the high stability of P-Salt. There is no problem with preparing and replenishing this electrolyte because P-Salt of good quality is commercially available. This electrolyte does not absorb $CO_2$ from atmosphere and does not require periodical addition of alkali, acid nor ammonium hydroxide. This electrolyte does not generate toxic vapors and plating results from this electrolyte are highly consistent.

In the platinum electroplating of such gas turbine hardware as turbine blades and vanes, the hardware is made the cathode and an anode comprising platinum or platinized titanium is used to complete the electrical circuit. Once the plating is complete, a platinum modified aluminide diffusion coating having improved oxidation resistance is grown by aluminizing the blade or vane using commercially available aluminizing processes, such as pack cementation, above the pack (gas-phase), chemical vapor deposition, slurry, and physical vapor deposition. After which the aluminum is completely diffused into the platinum by heat treatment at about 1900 F.

EXAMPLE 1

A Pt electrolyte was prepared by dissolution of 16.7 g P-Salt (10.0 g Pt) and 100 g Na2CO3 in 1 L water. A disc of Ni alloy of 0.60 "(D)×0.25" (H) were polished with SiC sandpaper Grit 600, blasted with glass beads, cleaned in ultrasonic cleaner with acetone and electroplated with 0.4–1.1 micron Pt coating at DC current density 0.5 A/dm2 and voltage 1.1 V at 60 C with Pt anode. Pt coating was light, semi-bright and highly adherent (scratch test). No insoluble Pt powder was detected on the anode and in the bath. Purity of Pt coating in terms of S, P, Cl and K content was equal or 2–7 times higher than that of Ni alloy substrate.

TABLE 1

Purity of Pt Coating and Ni Alloy Substrate (number of X-Ray Fluorescence counts)

| Object | S | P | Cl | K |
|---|---|---|---|---|
| Pt coating | 474 | 610 | 298 | 248 |
| Ni alloy substrate | 910 | 600 | 1316 | 1885 |

Note
The S level of the nickel alloy substrate was less than 3 ppm measured by bulk means which are not applicable to the coating.

EXAMPLE 2

Four Ni alloy disks were Pt electroplated like in Example 1, but Pt electrolyte was made up from NaHCO3, and P-Salt was purified by re-crystallization from water. Purity of Pt coating in terms of S, P, Cl, Na and K content was equal or 50–400 times higher than in Example 1, was equal or 400–800 times higher than that of Ni alloy substrate, and was 1.5–2000 times higher than that of commercial Pt electroplating (Table 2).

TABLE 2

Purity of Pt Coating and Ni Alloy Substrate (number of X-Ray Fluorescence counts)

| Object | S | P | Cl | Na | K |
|---|---|---|---|---|---|
| Pt coating # | | | | | |
| 1 | 485 | 255 | 0 | 319 | 14 |
| 2a | 467 | 239 | 0 | 228 | 7 |
| 2b | 415 | 249 | 0 | 241 | 0 |
| 3 | 465 | 226 | 0 | 278 | 42 |
| 4 | 431 | 236 | 0 | 320 | 0 |
| Ni alloy substrate | 544 | 219 | 396 | N.A. | 800 |
| Commercial Pt coating | 1171 | 309 | 663 | 713 | 2054 |

Note
The S level of the Ni alloy substrate is less than 3 ppm.

Though the invention has been described with respect to the preferred embodiment, it should be appreciated that this description of the invention should be considered exemplary and not as limiting the scope and spirit of the invention as set forth in the following claims.

What is claimed is:

1. A method of improving oxidation resistance of a platinum modified aluminide diffusion coating on a substrate, comprising electroplating the substrate with a layer comprising platinum from an aqueous electroplating solution based on a carbonate, said aqueous electroplating solution being substantially free of chlorine, sulfur, phosphorous and compounds thereof, and aluminizing the electroplated substrate at an elevated temperature to grow a platinum modified aluminide diffusion coating having improved oxidation resistance.

2. The method of claim 1 wherein the electroplating solution is based on an alkali metal carbonate.

3. The method of claim 2 wherein the alkali metal carbonate is $M_2CO_3$ where M is selected from a group comprising lithium (Li), sodium (Na), potassium (K), rubidium (Rb) and cesium (Cs).

4. The method of claim 3 wherein the alkali metal carbonate is present in the electroplating solution in an amount between 0.1 to 240 g/lit.

5. The method of claim 4 wherein platinum is present in the solution in the form of a platinum salt in the range of 0.01 to 320 g/lit.

6. A method of improving oxidation resistance of a nickel or cobalt based superalloy substrate, comprising electroplating the substrate with a layer comprising platinum from an aqueous electroplating solution based on a carbonate, said aqueous electroplating solution being substantially free of chlorine, sulfur, phosphorous and compounds thereof, and aluminizing the electroplated substrate at an elevated temperature to grow a platinum modified aluminide diffusion coating having improved oxidation resistance.

7. The method of claim 6 wherein the electroplating solution is based on an alkali metal carbonate.

8. The method of claim 7 wherein the alkali metal carbonate is $M_2CO_3$ where M is selected from a group comprising lithium (Li), sodium (Na), potassium (K), rubidium (Rb) and cesium (Cs).

9. The method of claim 8 wherein the alkali metal carbonate is present in the electroplating solution in an amount between 0.1 to 240 g/lit.

10. The method of claim 9 wherein platinum is present in the solution in the form of a platinum salt in the range of 0.01 to 320 g/lit.

11. A method of improving oxidation resistance of a platinum modified aluminide diffusion coating on a substrate, comprising:

electroplating the substrate with a layer comprising platinum from an aqueous electroplating solution based on an alkali metal carbonate which is $M_2CO_3$ wherein M is selected from a group comprising lithium (Li), sodium (Na), potassium (K), rubidium (Rb) and cesium (Cs), wherein the alkali metal carbonate is present in the electroplating solution in an amount between about 0.1 to 240 g/lit and platinum is present in the solution in the form of a platinum salt in the range of about 0.01 to 230 g/lit;

said aqueous electroplating solution being substantially free of chlorine, sulfur, phosphorous and compounds thereof, and aluminizing the electroplated substrate at an elevated temperature to grow a platinum modified aluminide diffusion coating having improved oxidation resistance.

12. A method of improving oxidation resistance of a nickel or cobalt based superalloy substrate, comprising:

electroplating the substrate with a layer comprising platinum from an aqueous electroplating solution based on an alkali metal carbonate which is $M_2CO_3$ wherein M is selected from a group comprising lithium (Li), sodium (Na), potassium (K), rubidium (Rb) and cesium (Cs), wherein the alkali metal carbonate is present in the electroplating solution in an amount between about 0.1 to 240 g/lit and platinum is present in the solution in the form of a platinum salt in the range of about 0.01 to 230 g/lit;

said aqueous electroplating solution being substantially free of chlorine, sulfur, phosphorous and compounds thereof; and aluminizing the electroplated substrate at an elevated temperature to grow a platinum modified aluminide diffusion coating having improved oxidation resistance.

* * * * *